United States Patent [19]

Smith

[11] 4,082,335

[45] Apr. 4, 1978

[54] PORTABLE DOOR SECURING DEVICE

[76] Inventor: Homer H. Smith, 90 Arden Park, Detroit, Mich. 48202

[21] Appl. No.: 766,051

[22] Filed: Feb. 4, 1977

[51] Int. Cl.[2] ..... E05C 19/18

[52] U.S. Cl. ..... 292/291

[58] Field of Search ..... 292/289–298

[56] References Cited

U.S. PATENT DOCUMENTS

| | | | |
|---|---|---|---|
| 359,815 | 3/1887 | Sargent | 292/291 |
| 2,288,022 | 6/1942 | O'Brien et al. | 292/291 |
| 3,429,151 | 2/1969 | Weingart | 292/291 X |

*Primary Examiner*—Richard E. Moore

*Attorney, Agent, or Firm*—Clarence A. O'Brien; Harvey B. Jacobson

[57] ABSTRACT

A portable door securing device or lock particularly adapted for use by travelers so that such persons can secure a door, such as in a motel, hotel, or the like, in a closed condition. The device is also useful in homes, apartments, or the like, where it is desired to utilize a door lock in addition to or in lieu of the normally provided key operated lock. The device includes a rigid rectangular block having an adjustably mounted latch bolt with a lateral extension on one end thereof for engagement in the usual keeper or latch plate on the door frame with the latch bolt extending between the edge of the door and the door frame. The bolt is adjustably secured to the block which bridges the juncture between the edge of the door and the door frame for retaining the door in closed position. The block is provided with an adjustable abutment to facilitate its use with doors and door frames having various contours, offsets, set backs, and the like, and in certain embodiments, the structure of the block enables the latch bolt to be rapidly removed in the event of an emergency.

5 Claims, 4 Drawing Figures

FIG. 1
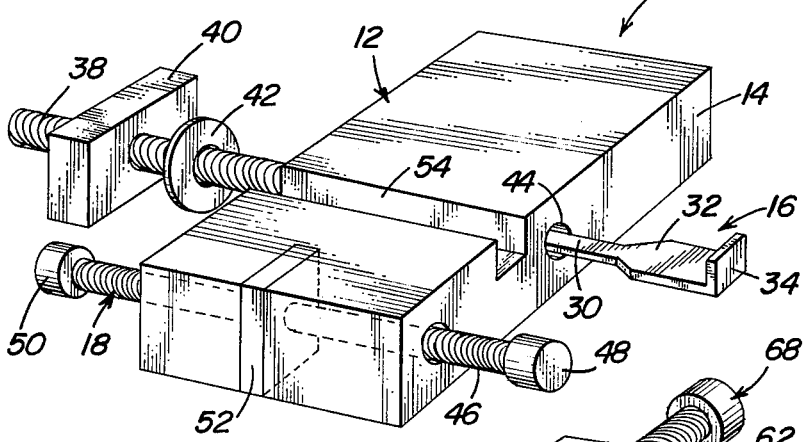
FIG. 3
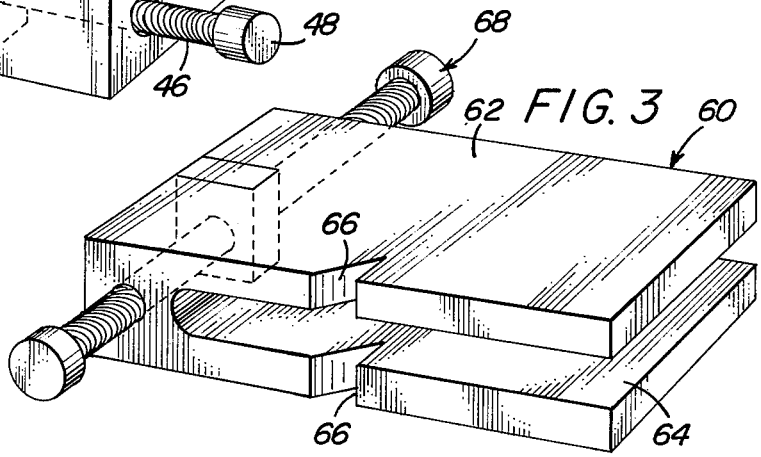
FIG. 4
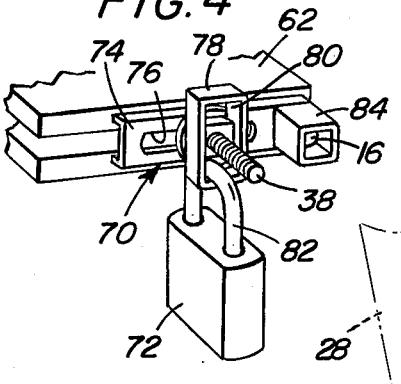
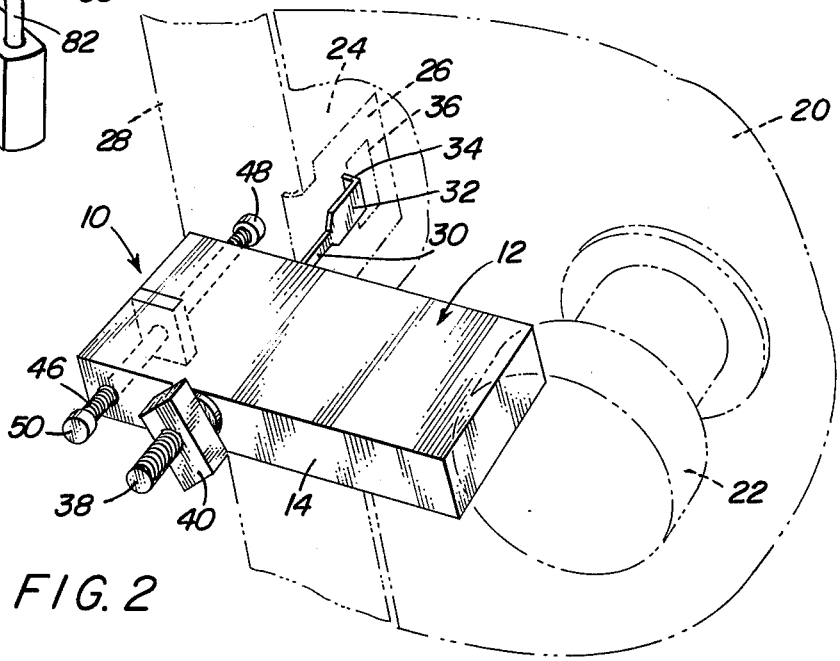
FIG. 2

PORTABLE DOOR SECURING DEVICE

BACKGROUND OF THE INVENTION

1. Field of the Invention

The present invention generally relates to a door securing device which is portable in nature and adapted to be used wherever it is desired to secure a swinging door in a closed position with the device including a latch bolt insertable between the door and door jamb and engaged with the keeper together with a rectangular member bridging the door and door jamb facing in an adjustable manner to prevent the edge of the door from swinging towards its open position in relation to the door jamb.

2. Description of the Prior Art

Many devices have been provided for locking doors in their closed position. Key operated lock mechanisms are usually associated with such devices in order to enable the doors to be opened when desired. However, it frequently occurs that unauthorized persons gain possession of door keys thus enabling unauthorized entry into the premises normally protected by the locked door. This is especially a problem in motels, hotels, and other similar accommodations for travelers. In efforts to alleviate this problem, portable devices have been invented to enable a traveler or other person to securely lock a door when he is occupying the premises, so that even if the key operated lock is unlocked, the door still will be retained in a closed position. The following U.S. patents disclose exemplary developments in this field of endeavor:

U.S. Pat. No. 359,815 — Mar. 22, 1887 — Sargent
U.S. Pat. No. 540,423 — June 4, 1895 — Chivill
U.S. Pat. No. 1,255,996 — Feb. 12, 1918 — Ehrhardt
U.S. Pat. No. 1,293,414 — Feb. 4, 1919 — Grimeck
U.S. Pat. No. 1,467,057 — Sep. 4, 1923 — Moglich
U.S. Pat. No. 3,352,587 — Nov. 14, 1967 — Harvey.

SUMMARY OF THE INVENTION

An object of the present invention is to provide a portable securing device for doors or other pivotal closures received in a frame or jamb having a keeper or latch plate associated therewith in which the door is capable of swinging in only one direction from a closed position within the frame or jamb to an open position.

Another object of the invention is to provide a door securing device in accordance with the preceding object including an elongated rectangular rigid member adapted to bridge the juncture between the swinging edge of the door and the adjacent door frame, door jamb or facing and a latch bolt extending between the swinging edge of the door and the door frame or jamb which is provided with a lateral extension received in the keeper or latch plate and an adjustable connection with the rigid member so that the rigid member may be adjusted into secure abutting engagement with the door and adjacent door frame, jamb or facing.

A further object of the invention is to provide a door securing device in which the rigid member bridging the door and door frame, jamb or facing includes an adjustable abutment member in the form of a threaded bolt having a rubber tipped inner end engageable with the door, door frame, door jamb, or facing to enable the securing device to be employed with various door and door frame arrangements having various surfaces oriented in offset relation to each other or adapting the device for use with curved surfaces or irregular surfaces on a door frame facing.

Still another object of the invention is to provide a portable door securing device in accordance with the preceding objects in which the latch bolt and rigid member are interconnected in a manner that enables the rigid member to be quickly disassembled from the latch bolt to enable rapid opening of the door in the event of an emergency.

Yet another important feature of the invention is to provide a door securing device which is relatively simple in construction, lightweight, easy to carry when travelling and inexpensive but quite effective in providing a secure and temporary locking device for a door.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of one embodiment of the portable door securing device of the present invention.

FIG. 2 is a perspective view of the door securing device illustrating the manner of use thereof in association with a door and door frame with keeper.

FIG. 3 is a perspective view of another embodiment of the door securing device.

FIG. 4 is a fragmental perspective view of an adapter enabling a padlock to be used to securely lock a closet door.

DESCRIPTION OF THE PREFERRED EMBODIMENTS

The portable securing device illustrated in FIG. 1 is generally designated by numeral 10 and includes a rigid bridging member generally designated by numeral 12 which is in the form of a solid or hollow block 14 of rectangular configuration and of a size convenient to be carried in a suitcase, or the like, by travelers so that it will be readily available for use in a hotel room, motel room, or the like. A latch bolt generally designated by numeral 16 is associated with the rigid bridging member 12 and an adjustable abutment member generally designated by numeral 18 is also associated with the member 12. As illustrated in FIG. 2, the portable securing device 10 can be associated with a door 20 provided with the usual door knob 22, which may have a key operated mechanism associated therewith with the door being received in a door jamb or frame 24 against a door stop (not shown) with the usually provided latch bolt in the door engageable with a keeper or latch plate 26 rigidly fixed to the door jamb 24. The door jamb or frame 24 is usually provided with a facing 28 that may be spaced inwardly from the surface of the door 20 when in closed position and may be irregular in configuration, such as having stepped surfaces or rounded surfaces.

The latch bolt 16 includes a flat, relatively narrow, thin, elongated portion 30 which widens into a plate-like portion 32 at its inner end with the plate-like portion 32 including a lateral member 34 perpendicular thereto which has a vertical heighth and lateral dimension capable of fitting into the recess or aperture 36 in the keeper plate 26 with the plate-like portion 32 and the adjacent portion 30 received between the swinging edge of the door 20 and the door jamb 24. The outer end of the elongated narrow portion 30 is in the form of an externally threaded rod 38 having a rectangular retaining nut 40 threaded thereon and a washer 42 disposed inwardly of the nut 40.

In one embodiment of the device, the block 14 is provided with an aperture 44 extending therethrough receiving the narrow portion 30 of the latch bolt 16 so that when the latch bolt 16 is engaged with the keeper recess or socket 36 and the narrow portion 30 is inserted through the aperture 44, the nut 40 may be tightened thus securing the block 14 in bridging relation to the juncture between the edge of the door 20 and the door jamb 24 thereby preventing the door 20 from swinging inwardly into the room away from the door stop thus maintaining the door securely in closed position.

To retain the rigid member 12 in generally parallel relation to the door, the adjustable abutment member 18 is adjusted by rotating the member 18 which is in the form of an externally threaded bolt 46 having a rubber tip 48 on the inner end thereof and a corresponding tip 50 on the outer end thereof. The screw threaded bolt 46 is screw threaded through a nut 52 incorporated into the block 14. If the block 14 is hollow, two nuts should be provided, one adjacent each of the opposed edges, but if the block 14 is of a solid construction of metal, wood, or plastic, then only a single nut 52 is necessary. The adjustable abutment 18 engages the facing 28 or any other adjacent surface either on the door frame or on the door to orient the rigid member 12 in bridging relation to the juncture between the door and the frame and generally in parallel relation to the door so that the latch bolt 16 will be perpendicular to the door thereby properly orienting the components for effectively securing the door in closed position.

The rigid member 12 includes a transverse groove 54 in one surface thereof which is adapted to receive the latch bolt 16. When the latch bolt 16 is placed in the groove 54 rather than through the aperture 44, operation of the device is the same except that in this situation, the rigid member 12 may be rapidly removed from the latch bolt 16 by lateral movement of the rigid member 12 after the nut 40 has been loosened slightly or, in some instances, the rigid member may be removed without loosening the nut 40 by striking the surface of the rigid member so that the striking force will overcome the frictional engagement between the washer 42 and the rigid member 12. A typical installation is illustrated in FIG. 2 with the embodiment illustrated in FIG. 2 including only the aperture 44 and not the groove 54, although the groove may be provided at any desired point along the length of the block 14.

FIG. 3 illustrates another embodiment of the portable securing device generally designated by numeral 60 which includes a block 62 having an elongated groove or slot 64 formed therein which communicates with one end wall. The groove or slot 64 receives the latch bolt in the same manner as the groove 54, except that instead of lateral pressure being exerted on the block to separate it from the latch bolt, longitudinal pressure is exerted on the block 62. Also, in this arrangement, the edge of the block 62 facing the door keeper is provided with notches 66 which receives the outer curved end edge of the keeper plate 26. This structure enables positioning of the latch bolt at any point along the length of the block thus adapting it to various structural arrangements of doors and door frames. The securing device 60 also includes the adjustable abutment member 68 which corresponds to the abutment member 18 illustrated in FIGS. 1 and 2.

The retaining nut 40 may be rectangular as illustrated or it may be in the form of a wing nut to facilitate manipulation thereof. Also, the outer end of the threaded bolt 46 may be provided with laterally extending wings or ears to facilitate rotation thereof. The block 14 may be constructed of plastic material or of metal, wood, or the like, either solid or hollow. Thus, the device may be rather inexpensively constructed and the dimensions may be such that it can be easily carried in a suitcase, or the like, by a traveler. For example, the block 14 may have a length of approximately 3 to 4 inches, a width of approximately 1½ inches and a thickness of approximately ½ inch. The latch bolt 16 may have a length of approximately 5 inches which has been found to be adequate to fit most door arrangements, such as those found in hotels, motels, homes, apartments, and the like. The specific materials and dimensional characteristics of the device may vary in order to accommodate variations in door structures which may be encountered.

With this device installed, a door cannot be opened from the outside even though the proper key may be inserted into the normally provided key operated lock, thereby providing the occupant of the room total security from unauthorized entry by unauthorized persons.

FIG. 4 illustrates an adapter 70 enabling a key operated or combination padlock 72 to secure a closet door or the like in a closed position. The adapter 70 includes a rigid strap 74 having a longitudinal slot 76 therein which receives the threaded end 38 of the latch bolt. The strap 74 is positioned under a retaining nut 78 which is similar to the nut 40 except that it is provided with an aperture 80 in each end thereof for receiving the hasp 82 of the padlock 72.

The strap 74 also includes a rigid tubular sleeve 84 on one end thereof which is square or polygonal in configuration for positioning over the head of the adjustable abutment member 18 which may be round or polygonal to prevent access thereto.

With this arrangement, a hotel or motel guest may place a suitcase or other possessions in a closet or the like and securely lock the closet door so that no one can gain access thereto even though they may gain access to the room. This device is also effective to lock any swinging door securely in a closed position and the block 62 or 14 may be used therewith.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A portable door securing device comprising a rigid bridging member adapted to bridge the juncture between the swinging edge of a door and a door frame to prevent swinging movement of the door toward an open position, and a latch bolt adjustably secured to said member and adapted to extend between the swinging edge of the door and the door jamb, said latch bolt including a lateral extension on the end thereof adapted to be received within a recess in the door jamb defined by a keeper plate, means adjustably interconnecting the latch bolt and rigid member to enable the rigid member to be moved toward the door and door frame, and abutment means on said rigid member in opposed relation to the lateral extension on the latch bolt for maintaining the rigid member generally perpendicular to the latch bolt, said rigid member including a rigid block, said latch bolt including a threaded portion extending transversely of the block, said means adjustably connecting the latch bolt to the block including a hand manipulable nut on the threaded portion of the latch bolt for adjusting the latch bolt toward and away from the block, said block including a transversely extending groove communicating with a flat surface thereof for receiving said latch bolt thus enabling separation of the block from the latch bolt in a rapid manner in the event or emergency.

2. A portable door securing device comprising a rigid bridging member adapted to bridge the juncture between the swinging edge of a door and a door frame to prevent swinging movement of the door toward an open position, and a latch bolt adjustably secured to said member and adapted to extend between the swinging edge of the door and the door jamb, said latch bolt including a lateral extension on the end thereof adapted to be received within a recess in the door jamb defined by a keeper plate, means adjustably interconnecting the latch bolt and rigid member to enable the rigid member to be moved toward the door and door frame, and abutment means on said rigid member in opposed relation to the lateral extension on the latch bolt for maintaining the rigid member generally perpendicular to the latch bolt, said rigid member including a rigid block, said latch bolt including a threaded portion extending transversely of the block, said means adjustably connecting the latch bolt to the block including a hand manipulable nut on the threaded portion of the latch bolt for adjusting the latch bolt toward and away from the block, said block including an elongated slot therein communicating with an end edge of the block for receiving said bolt and enabling separation of the block from the latch bolt in the event of an emergency, said block including a notch in one edge thereof adapted to receive the projecting tongue on a keeper plate.

3. A portable door securing device comprising a rigid bridging member adapted to bridge the juncture between the swinging edge of a door and a door frame to prevent swinging movement of the door toward an open position, and a latch bolt adjustably secured to said member and adapted to extend between the swinging edge of the door and the door jamb, said latch bolt including a lateral extension on the end thereof adapted to be received within a recess in the door jamb defined by a keeper plate, means adjustably interconnecting the latch bolt and rigid member to enable the rigid member to be moved toward the door and door frame, and abutment means on said rigid member in opposed relation to the lateral extension on the latch bolt for maintaining the rigid member generally perpendicular to the latch bolt, said rigid member including a rigid block, said latch bolt including a threaded portion extending transversely of the block, said means adjustably connecting the latch bolt to the block including a hand manipulable nut on the threaded portion of the latch bolt for adjusting the latch bolt toward and away from the block, an adapter positioned on said threaded portion of the latch bolt in underlying relation to the nut, said nut including aperture means therein receiving a padlock to prevent removal of the device even if the nut is accessible, said adapter including a sleeve on one end thereof disposed in protective relation to said abutment means to prevent access thereto.

4. A portable door securing device comprising a rigid bridging member adapted to bridge the juncture between the swinging edge of a door and a door frame to prevent swinging movement of the door toward an open position, and a latch bolt adjustably secured to said member and adapted to extend between the swinging edge of the door and the door jamb, said latch bolt including a lateral extenstion on the end thereof adapted to be received within a recess in the door jamb defined by a keeper plate, means adjustably interconnecting the latch bolt and rigid member to enable the rigid member to be moved toward the door and door frame, and abutment means on said rigid member in opposed relation to the lateral extension on the latch bolt for maintaining the rigid member generally perpendicular to the latch bolt, said rigid member including a rigid block, said latch bolt including a threaded portion extending transversely of the block, said means adjustably interconnecting the latch bolt and block including a hand manipulable nut on the threaded portion of the latch bolt for adjusting the latch bolt toward and away from the block, said abutment means including a threaded member threadedly engaged with said block and including a tip on the inner end thereof for engagement with a supporting surface in spaced relation to the latch bolt, said block including a groove-like recess extending from inner to outer edges thereof and communicating with the lateral periphery thereof to enable rapid separation of the block from the bolt in the event of an emergency.

5. The structure as defined in claim 4 wherein said hand manipulable nut is provided with an adapter having an aperture therein adapted to receive a padlock to prevent relative rotation between the nut and block thereby enabling the device to be used to secure a door in closed position even if access is available to the door securing device.

* * * * *